US007942645B2

(12) United States Patent
Nakatsuka et al.

(10) Patent No.: US 7,942,645 B2
(45) Date of Patent: May 17, 2011

(54) OIL PUMP ASSEMBLY

(75) Inventors: Masahiko Nakatsuka, Saitama (JP); Masaki Cho, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 854 days.

(21) Appl. No.: 11/284,843

(22) Filed: Nov. 23, 2005

(65) Prior Publication Data

US 2006/0112907 A1 Jun. 1, 2006

(30) Foreign Application Priority Data

Nov. 26, 2004 (JP) ..... 2004-341535
Nov. 29, 2004 (JP) ..... 2004-344656

(51) Int. Cl.
*F04B 49/00* (2006.01)

(52) U.S. Cl. ..... 417/286; 417/440; 417/304; 123/196 R

(58) Field of Classification Search ..... 417/440, 417/286, 307, 308, 304; 123/196 R
See application file for complete search history.

(56) References Cited

U.S. PATENT DOCUMENTS 2,724,335 A * 11/1955 Eames ..... 417/79
3,244,111 A * 4/1966 Shelhart ..... 418/133
4,971,528 A * 11/1990 Hodgkins et al. ..... 417/310
6,830,439 B2 * 12/2004 Stephens ..... 417/307
6,837,209 B2 * 1/2005 Hori et al. ..... 123/196 R
2005/0180870 A1 * 8/2005 Stanley et al. ..... 417/440

FOREIGN PATENT DOCUMENTS

JP 7-102930 A 4/1995
JP 2000-199413 A 7/2000
JP 2000-220430 A 8/2000

* cited by examiner

*Primary Examiner* — Charles G Freay
*Assistant Examiner* — Todd D Jacobs
(74) *Attorney, Agent, or Firm* — Birch Stewart Kolasch & Birch, LLP

(57) ABSTRACT

An oil pump assembly includes a plurality of pump chambers constituting a plurality of oil pumps, respectively, a plurality of rotors are fitted into the pump chambers, respectively, with a single driving shaft carrying the plurality of rotors to form a single body. Oil pumped up from an oil pan is supplied under pressure to different associated destinations with the relief valves being arranged compactly to reduce the size of the oil pump assembly. Oil pumps are provided with respective relief valves provided to pass oil discharged from the corresponding pump chambers therethrough and the axes of the relief valves are arranged parallel to the driving shaft. A driving shaft is provided on which a plurality of the inner rotors are carried concentrically and integrally. The rotors are connected to the driving shaft and changed depending on discharge oil pressures, thereby preventing the driving shaft from increasing its diameter.

11 Claims, 14 Drawing Sheets

FIG. 10(a)
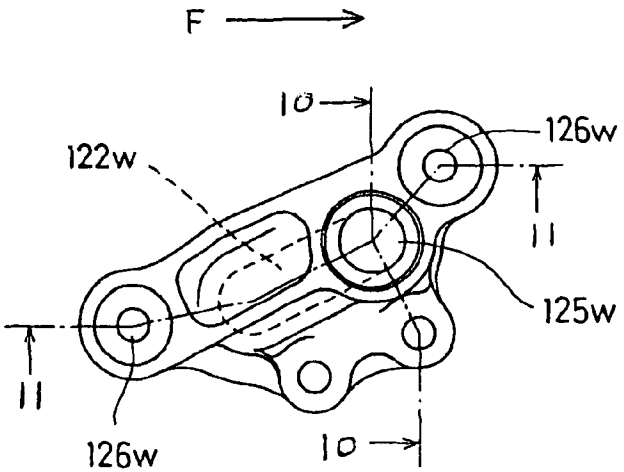
FIG. 10(b)
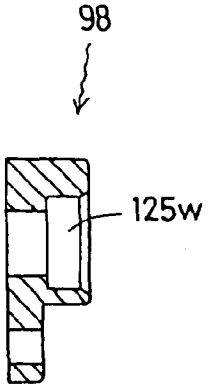
FIG. 10(c)
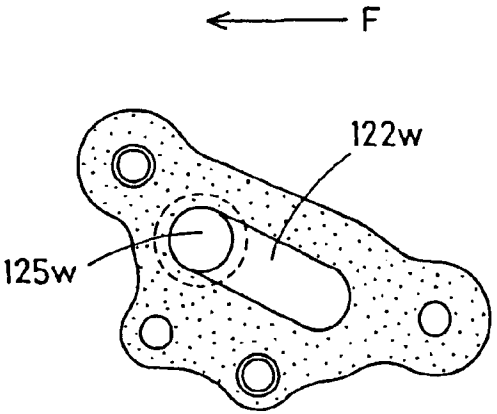
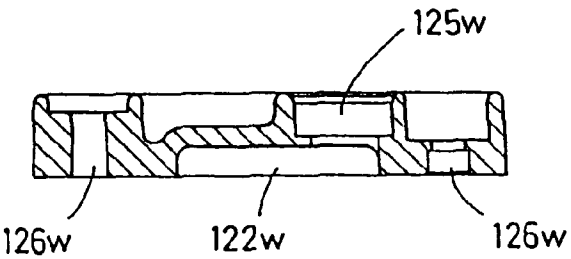
FIG. 10(d)

OIL PUMP ASSEMBLY

CROSS-REFERENCE TO RELATED APPLICATIONS

The present application claims priority under 35 USC 119 to Japanese Patent Application No. 2004-341535 filed on Nov. 26, 2004 and Japanese Patent Application No. 2004-344656 filed on Nov. 29, 2004 the entire contents of which are hereby incorporated by reference.

FIELD OF THE INVENTION

The present invention relates to an oil pump assembly integrally composed of a plurality of oil pumps through a common driving shaft, the oil pumps each including a relief valve. In addition, the invention relates to an oil pump structure integrally composed of a plurality of oil pumps having respective different discharge pressures, driven with common driving shaft, and to an oil pump structure combining the oil pumps with a water pump.

DESCRIPTION OF BACKGROUND ART

One example of a conventional technique relates to a pair of rotors that are carried on a driving shaft coaxially and integrally with a relief valve that is disposed between the pair of rotors and directed toward the driving shaft in a direction perpendicular thereto. See, for example, Japanese Patent Laid-open No. 2000-199413. If it is necessary to feed oil to the components of a power unit at respective different hydraulic pressures, oil pumps are provided at its discharge sides with relief valves having respective different pressures so that oil may be fed to destinations at respective different hydraulic pressures. However, in such an arrangement described above, the plurality of relief valves project in a direction perpendicular to the driving shaft, which increases the sizes of the oil pumps. Consequently, the oil pumps will largely occupy the layout-based restrictive space in the internal of the power unit.

One example of a conventional oil pump structure that includes a plurality of oil pumps having the same discharge pressure that are integrally combined with each other through a single driving shaft. See, for example, Japanese Patent Laid-open No. 2000-199413, FIG. 3. This example discloses that a plurality of rotors are secured to the driving shaft by means of corresponding connection pins.

If one of the plurality of oil pumps is for high pressure and the other is for low pressure, hydraulic pressures applied to the rotors are different from each other, which leads to different torque for driving the rotors. As the torque is increased, it is necessary to increase the diameter of the rotor connection pin. The increased diameter of the pin requires an enlarged pin insertion hole. Thus, an increased diameter of the driving shaft is required which is likely to increase the weight of the oil pump.

The present invention intends to solve the problem of the conventional technique described above and provide means for arranging a plurality of relief valves in a compact manner, thereby reducing the size of an oil pump assembly.

An embodiment of the present invention provides an oil pump assembly that includes a plurality of pump chambers constituting a plurality of oil pumps, respectively with a plurality of rotors fitted into the pump chambers, respectively. A single driving shaft carries the plurality of rotors to form a single body wherein oil pumped up from an oil pan is supplied under pressure from the plurality of oil pumps to different associated destinations in a power unit. The oil pumps are provided with respective relief valves adapted to pass oil discharged from the corresponding pump chambers therethrough and axes of the relief valves are arranged parallel to the driving shaft.

An embodiment of the present invention provides a discharge port for at least one of the relief valves that is disposed within a width of the rotors as viewed from a direction perpendicular to the driving shaft.

An embodiment of the present invention provides respective discharge ports of the relief valves that are disposed within a width of the rotors as viewed from a direction perpendicular to the driving shaft with the relief valves being arranged to have most portions of the full lengths that overlap each other.

An embodiment of the present invention provides an outer shell of the oil pump assembly that is composed of a pump case body and pump covers shielding lateral sides of the pump cover, the pump chambers are defined between the pump case body and the pump covers to house the rotors in the corresponding pump chambers. The plurality of relief valves are arranged to be inserted in cavities of the pump case body.

An embodiment of the present invention provides for a plurality of relief valves that are disposed between a strainer and the oil pumps as viewed from the lateral side of the power unit.

An embodiment of the present invention provides for the plurality of relief valves that are arranged parallel to each other along an oil stream line of an oil inflow passage extending from the strainer to the oil pumps.

According to an embodiment of the present invention, since the axes of the plurality of relief valves are arranged parallel to the driving shaft, the drive shaft can be brought close to the relief valves, so that the relief valves can be arranged compactly.

According to an embodiment of the present invention, since the discharge port of the relief valve is disposed within the width of the rotor as viewed from a direction perpendicular to the driving shaft, the relief valve can be brought close to the oil pump for a compact arrangement. In addition, the discharge oil passage is brought close to the pump suction port to shorten the relief oil passage, thereby simplifying the oil passages.

According to an embodiment of the present invention, since the respective discharge ports of the relief valves are disposed within the width of the rotors and the relief valves are arranged to have most portions of the full lengths that overlap each other, the plurality of the relief valves can be further arranged in a compact manner. Note that "to have most portions of the full lengths that overlap each other" means that "a plane perpendicular to the axes of the relief valves are shared by most of the portions of the full lengths of the relief valves".

According to an embodiment of the present invention, since the oil pump assembly is composed of the pump case body and the pump covers shielding both the sides of the pump case body and the plurality of the relief valves are disposed by inserting them into the corresponding cavities of the pump case body, the number of components can be reduced by eliminating members used to support the relief valves.

According to an embodiment of the present invention, since the plurality of relief valves are disposed between the strainer and the oil pump as viewed from the lateral side of the power unit, an unused space between the strainer and the oil pumps is used to dispose the relief valves therein, thereby further reducing the size of the power unit.

According to an embodiment of the present invention, since the plurality of relief valves are arranged along the oil stream line extending from the strainer to the oil pump, the plurality of relief valves can be further arranged compactly while ensuring sufficient oil passages.

The present invention intends to prevent a driving shaft from increasing its diameter particularly for a high pressure pump by changing means for connecting rotors to the driving shaft depending on discharge oil pressures.

According to an embodiment of the present invention, the present invention solves the above problem by providing an oil pump assembly structure including a low pressure oil pump which includes a pump chamber, an outer rotor and an inner rotor that is adapted to pump oil in an oil pan and supply under pressure of the oil to components of a power unit. A high pressure oil pump which includes a pump chamber, an outer rotor and an inner rotor is adapted to pump oil in the oil pan and supply the oil under pressure to the other components of the power unit. A driving shaft is provided on which a plurality of the inner rotors are carried concentrically and integrally. The inner rotor of the low pressure oil pump is secured to the driving shaft by means of a retaining pin in such a manner so as to be unable to rotate with respective to the driving shaft. The inner rotor of the high pressure oil pump is fitted to a portion having a plurality of flat surfaces formed in the vicinity of an end of the driving shaft and is secured to the driving shaft in such a manner so as to be unable to rotate with respect to the driving shaft with the driving shaft being driven by receiving power of an internal combustion engine.

According to an embodiment of the present invention, oil pressurized in the pump chamber is symmetrically discharged from the rotor to both sides of the rotor, interflows and then is discharged from the oil pump.

According to an embodiment of the present invention, a water pump is provided adjacent to the low pressure oil pump of the oil pumps with a driving shaft of the water pump being disposed coaxially with the driving shaft of the oil pumps. A power transmission means is provided which receives power of the internal combustion engine and is located at an end of the oil pump driving shaft on a side of the low pressure oil pump with one of the end of the oil pump driving shaft and an end of the water pump driving shaft being formed in a projecting manner and the other being formed in a recessed manner. Thus, both the pump driving shafts are coupled to each other.

According to an embodiment of the present invention, since the inner rotor of the high pressure oil pump is fitted and secured to a portion having a plurality of flat surfaces formed in the vicinity of an end of the driving shaft, the strength of connection between the inner rotor and the driving shaft can be increased. Thus, it is unnecessary to increase the diameter of the driving shaft, thereby reducing the size of the oil pump. In addition, in the case of a flat surface fitting, not only the length of the flat surface can be set more freely but also the rotor having manufacturing or assembling errors can be attached to the driving shaft more freely in terms of the axial position thereof.

According to an embodiment of the present invention, since the oil that has passed the rotor is symmetrically discharged from the rotor to both the sides of the rotor, the pressure of the oil discharged to both sides provides a rotor-centering effect, which reduces the contact between the rotor and the pump chamber, thereby suppressing frictional resistance therebetween. Accordingly, a load acting on the driving shaft is reduced, so that the diameter of the driving shaft can be reduced.

According to an embodiment of the present invention, the power transmission means is provided at the end of the driving shaft on the side of the low pressure oil pump, the end of the driving shaft of the water pump is disposed coaxially with the end, and both the ends are fitted and coupled to each other. Therefore, a distance between the power transmission means and the projecting-recessed connection portion located at the end of the driving shaft is small, so that torsion acting on the driving shaft is reduced. Accordingly, it is unnecessary to reinforce the projecting-recessed connection portion and reduce the diameter of the driving shaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 10(*a*), 10(*b*), 10(*c*) and 10(*d*) are four-side view of a right outer side cover 98;

DETAILED DESCRIPTION OF THE PREFERRED EMBODIMENTS

Figure 1:
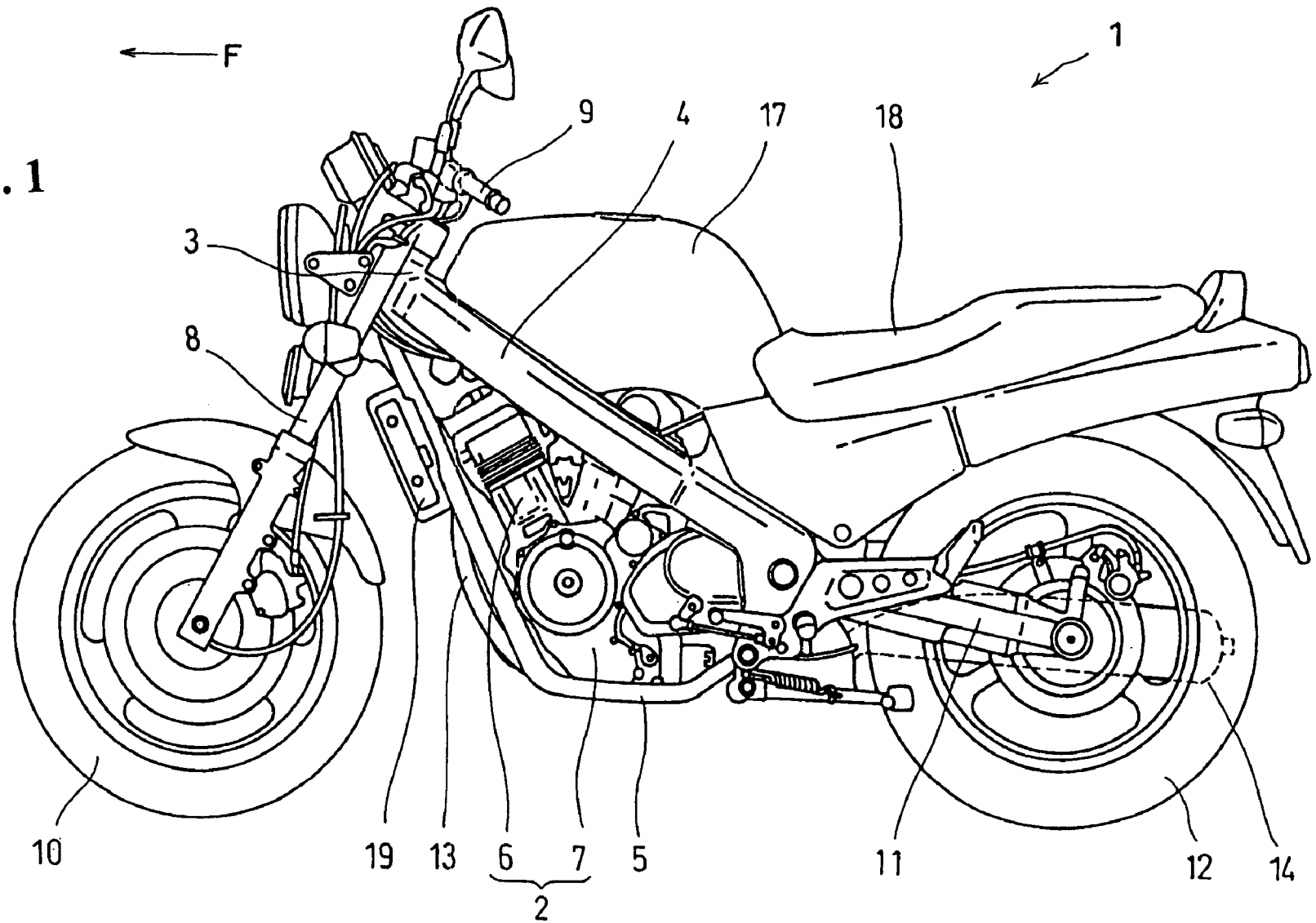
FIG. 1 is a lateral view of a motorcycle 1 according to an embodiment of the present invention.

FIG. 1 is a lateral view of a motorcycle 1 provided with a power unit according to an embodiment of the present invention. The motorcycle 1 has a pair of main frames 4 and a pair of subframes 5. The pair of main frames 4 is continuous to a head pipe 3 and slants rearwardly and downwardly. The pair of subframes 5 extends downwardly from the lower portion of the head pipe 4, bend rearwardly, and then the subframes 5 are joined at its ends to the rear ends of the main frames 4, respectively.

The power unit 2 is integrally composed of an internal combustion engine 6 and a transmission 7 that are mounted in an almost-triangular space, as viewed laterally and as defined by the main frames 4 and the subframes 5. The head pipe 3 rotatably supports a front fork 8, which has an upper end to which a steering handlebar 9 is attached and a lower end which rotatably supports a front wheel 10. The rear portions of the main frames 4 pivotally support the front ends of the pair of rear forks 11 so as to swing the rear forks 11 in an up-and-down direction. Rear shock absorbers (not shown) are attached between the middle portions of the rear forks 11 and the rear ends of the main frames 4, respectively. A rear wheel 12 is rotatably supported by the rear ends of the rear forks 11.

The internal combustion engine 6 mentioned above is a water-cooled V-type 2-cylinder internal combustion engine. The cylinders take a V-shape in the back-and-forth direction. A crankshaft of the engine 6 is disposed to be perpendicular to the advancing direction of the vehicle, that is, to extend in the lateral direction of the vehicle. A transmission shaft of the transmission 7 is parallel to the crankshaft mentioned above. A rear wheel driving shaft (not shown) is coupled to a connection shaft 85, see FIG. 2, perpendicular to the output shaft of the transmission and extends rearwardly of the vehicle and reaches the rear wheel 12 for driving the rear wheel 12.

An exhaust pipe 13 communicates with exhaust ports which are respectively disposed in the two cylinders at positions in the back and forth direction of the vehicle. The exhaust pipe 13 extends forward of the engine 6, goes around below the transmission 7 and reaches the rear of the vehicle, at which it is connected to an exhaust muffler 14. A fuel tank 17 is attached onto the body frame 4 and a seat 18 is attached to a portion in rear of the fuel tank 17. The engine 6 is of a water-cooled type. Cooling water that has risen in temperature in the process of cooling the cylinders and oil is cooled by a radiator 19 attached to the front of the subframes 5.

Figure 2:
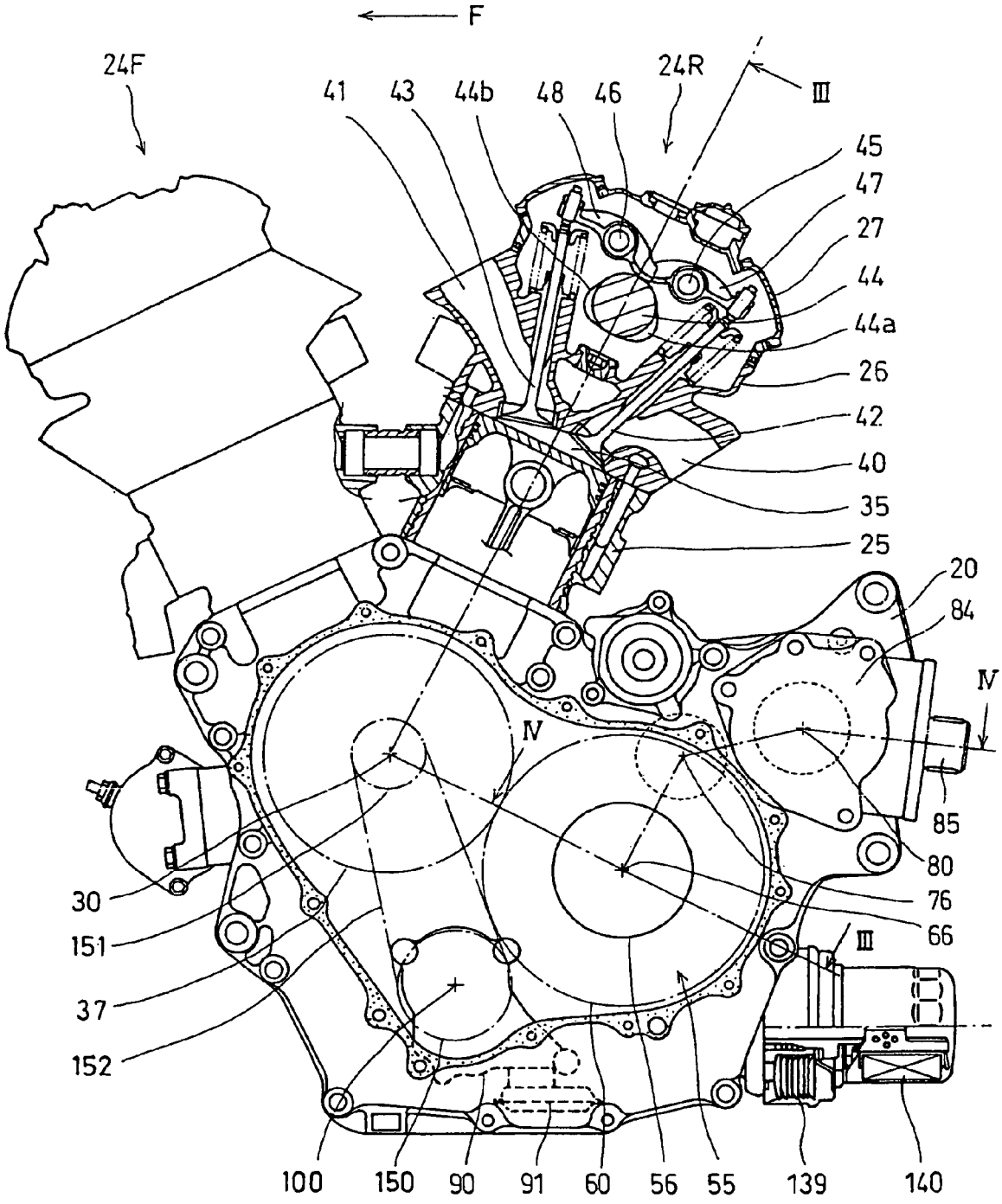
FIG. 2 is a left side view of a power unit 2 mounted on the vehicle.

FIG. 2 is a left-hand lateral view of the power unit 2 mounted on the motorcycle. Arrow F indicates the front of the vehicle when the power unit is mounted thereon. The same holds true for the other figures. Since the front cylinder 24F and the rear cylinder 24R have the same configuration, the cross-section of the rear cylinder 24R only is depicted. The crankcase portion is shown with a left-hand crankcase cover removed so as to indicate the respective internal positions of the primary rotary shafts, gears and sprockets.

Figure 3:
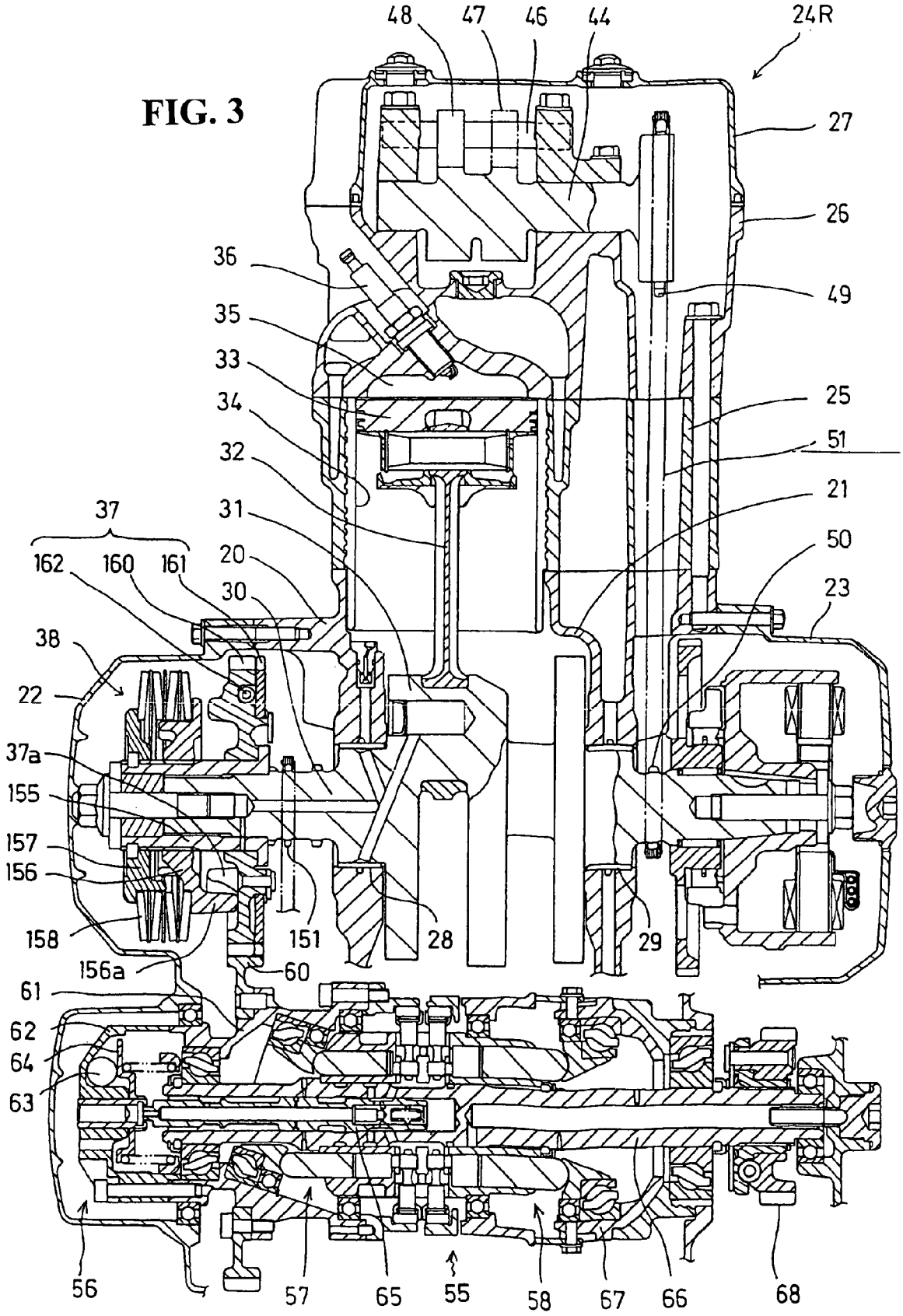
FIG. 3 is a cross-sectional development view taken along line III-III of FIG. 2.

FIG. 3 is a cross-sectional development view taken along line III-III of FIG. 2. FIG. 3 develops the section including the rear cylinder 24R, the crankshaft 30 and a transmission shaft 66 of a static hydraulic type continuously variable transmission 55. The rear cylinder 24R is adapted to hold a piston 33 connected to a left side crankpin 31.

Referring to FIGS. 2 and 3, the main outer shells of the power unit 2 include a left crankcase 20, a right crankcase 21, a left crankcase cover 22, and a right crankcase cover 23, as well as a cylinder block 25, a cylinder head 26 and a cylinder head cover 27 provided for each of the front cylinder 24F and the rear cylinder 24R.

In FIG. 3, the crankshaft 30 is journaled by a left bearing 28 and a right bearing 29 held by the left crankcase 20 and the right crankcase 21, respectively. A connecting rod 32 and the piston 33 are connected to a left crankpin 31 of the crankshaft 30. The piston 33 is slidably held within a cylinder bore 34 of the cylinder block 25. A combustion chamber 35 is formed at a portion of the cylinder head 26 that faces the piston 33. An ignition plug 36 is placed to pierce a wall body of the cylinder head 26 in such a manner that its top faces the combustion chamber 35 and its rear end is exposed to the exterior.

Referring to FIG. 2, an exhaust port 40 and an intake port 41 are each continuous with the combustion chamber 35. The exhaust port 40 of the front cylinder 24F extends forward, whereas that of the rear cylinder 24R extends rearwardly. The intake port 41 of any of the cylinders extends upwardly in a space defined between both the cylinders. An exhaust valve 42 is provided at the exhaust port 40 and an intake valve 43 is provided at the intake port 41. A camshaft 44 is placed in the cylinder head cover 27. An exhaust rocker arm shaft 45 and an intake rocker arm shaft 46 are provided above the camshaft 44. An exhaust rocker arm 47 and an intake rocker arm 48 attached to the respective arm shafts are driven by cams 44*a* and 44*b* of the camshaft 44 to push the stem tops of the exhaust valve 42 and the intake valve 43, respectively, thereby drivingly opening and closing the corresponding valves. Referring to FIG. 3, the camshaft 44 is driven by a camshaft driving chain 51 wound around a camshaft driven sprocket 49 provided at the end of the camshaft 44 and a camshaft driving sprocket 50 provided at the crankshaft 30.

In FIG. 3, the static hydraulic continuously variable transmission 55 is placed in rear of the crankshaft 30. This transmission is an apparatus integrally combining a centrifugal governor 56, a swash plate type hydraulic pump 57 and the swash plate type hydraulic motor 58 through the transmission shaft 66. A crankshaft output gear 37 attached to the left end of the crankshaft 30 is a gear functioning integrally with a cam type torque damper 38 adjacent thereto. The gear 37 has a meshing engagement with a transmission input gear 60 integrally joined to the casing 61 of the swash plate type hydraulic pump 57.

A crankshaft output gear 37 and a cam type torque damper 38 are carried on a collar spline-joined to the crankshaft 30. The crankshaft output gear 37 is rotatably fitted onto the collar 155 and is formed on its side surface with a recessed cam 37*a* having an arc-shaped recessed surface. A lifter 156 is axially movably fitted to a spline formed on the outer circumference of the collar 155 and is formed at its end surface with a projecting cam 156*a* having an arc-shaped projecting surface. The projecting cam 156*a* has a meshing engagement with the recessed cam 37*a*. A spring holder 157 is fastened to an end of the collar 155 by means of a spline and a cotter. Disc springs are placed between the spring holder 157 and the lifter 156 so as to urge the projecting cam 156*a* toward the recessed cam 37*a*.

In a case of a steady speed operation, the torque of the crankshaft 30 is transmitted through the collar 155, lifter 156, projecting cam 156, recessed cam 37*a* and crankshaft output gear 37 in this order. The crankshaft output gear 37 is rotated together with the crankshaft 30. If excessive torque is supplied to the crankshaft 30, while sliding on the cam surface of the recessed cam 37*a* in a circumferential direction, the projecting cam 156*a* axially moves against the urging force of the disc springs 158 to absorb the excessive torque, thereby alleviating a shock.

The crankshaft output gear 37 is a backlash reduction gear and is composed of a main gear 160 having a thick center portion, a thin sub-gear 161 which is carried by the main gear 160 in such a manner as to be coaxially rotatable with respect to the main gear 160, and a coil spring 162 which circumferentially urges the sub-gear 161 to the main gear 160. When a backlash reduction gear comes into a meshing engagement with an ordinary gear, a sub-gear is urged circumferentially to move for filling in a backlash gap defined between a main gear and the ordinary gear. This eliminates backlash and thereby provides reduced noise and quietness. In the present embodiment, the meshing engagement between the crankshaft output gear 37 and the transmission input gear 60 does not make any noise.

A casing 62 of the centrifugal governor clutch 56 is integrally joined to a casing 61 of the swash plate type hydraulic pump 57. If the rotating speed reaches or exceeds a certain level, a centrifugal weight 63 (e.g., a steel roller, a steel ball or the like) housed in the casing 62 of the centrifugal governor clutch 56 pushes a moving member 64, which moves a hydraulic circuit switching rod 65 coupled to the moving member 64, in the transmission shaft 66. Thus, the hydraulic circuit switching rod 65 closes an oil passage adapted to circulate oil discharged from the swash plate type hydraulic pump 57, thereby causing a switching to discharge the oil from the hydraulic pump 57 to flow toward the swash plate type hydraulic motor 58.

The swash plate type hydraulic pump 57 and the swash plate type hydraulic motor 58 are connected to each other at a speed change ratio corresponding to the inclination of a swash plate 67 included in the hydraulic motor 58. The rotating force thus changed is taken out of the transmission output gear 68 fixed to the transmission shaft 66 integral with the output part of the hydraulic motor 58. An angle of inclination of the swash plate 67 included in the hydraulic motor 58 is changed by a swash plate driving mechanism (not shown) that is driven by an electric motor.

Figure 4:
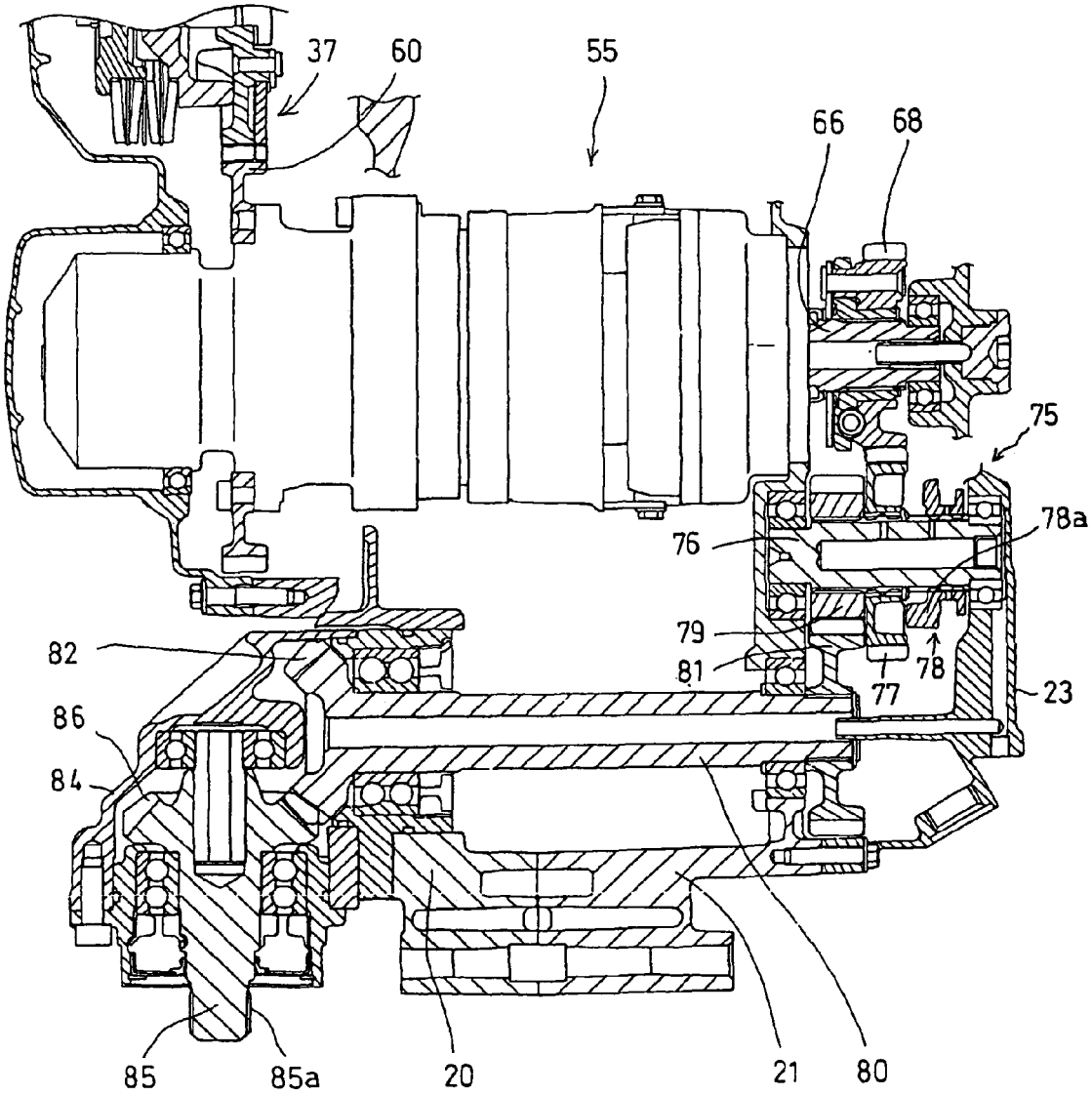
FIG. 4 is a cross-sectional view taken along line IV-IV of FIG. 2.

FIG. 4 is a cross-sectional view taken along line IV-IV of FIG. 2 that depicts a power transmission path extending from the transmission shaft 66 to the connection shaft 85. A clutch shaft 76 is journaled, parallel to the transmission shaft 66, by the right crankcase 21 and the right crankcase cover 23 through ball bearings. An output shaft 80 is journaled, parallel to the clutch shaft 76, by the left crankcase 20 and the right crankcase 21 through ball bearings. The connection shaft 85 is journaled, perpendicularly to the output shaft 80, by a connection shaft support portion 84 placed near the left end of the output shaft 80. The connection shaft support portion 84 is attached to a portion outside the left crankcase 20. See, also FIG. 2.

A gear 77 is loosely fitted to the clutch shaft 76 in a rotatable manner with respect to the axis thereof. The gear 77 has a meshing engagement with the transmission output gear 68 fitted to the transmission shaft 66. Adjacent to the gear 77, a sliding member 78 having engagement gear teeth 78*a* is loosely fitted to the clutch shaft 76 in an axially slidable manner. The clutch shaft 76, gear 77 and sliding member 78 constitute an electrically-driven or manually-operated mechanical clutch 75 which can connect and disconnect power transmission. The sliding member 78 is allowed to slide along the clutch shaft 76 to establish a meshing engagement between the meshing teeth 78*a* and an engagement portion of the gear 77, whereby the clutch is engaged, to thereby provide a driving state. The sliding member 78 is moved to disengage the engagement teeth 78*a* from the gear 77, whereby the clutch is disengaged, to provid a neutral state.

Adjacent to the gear 77, a gear 79 is fitted to the clutch shaft 76 on a side opposite to the sliding member 78 with respect to the gear 77. A gear 81 is fitted to the right end of the output shaft 80. The gear 81 has a meshing engagement with the gear 79 carried on the clutch shaft 76. A bevel gear 82 is formed integrally with the other end of the output shaft 80. A bevel gear 86 is formed integrally with the front end of the connection shaft 85 and has a meshing engagement with the bevel gear 82 carried on the output shaft 80. The rear end of the connection shaft 85 is formed with a spline 85*a* so as to be connected to the rear wheel driving shaft (not shown). Such shafts and gears transmit the rotating power of the static hydraulic type continuously variable transmission 55 to the rear wheel driving shaft.

Figure 5:
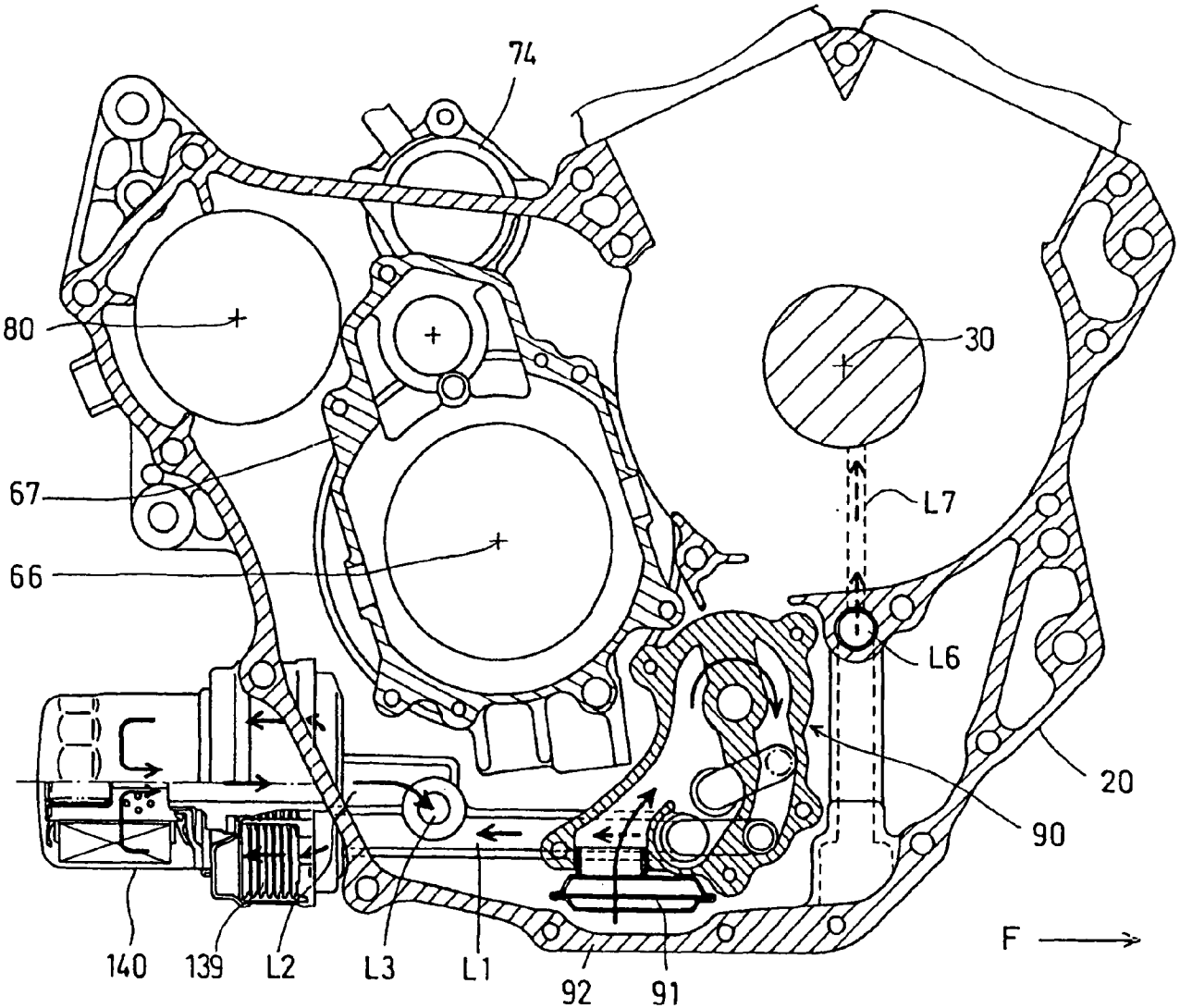
FIG. 5 is a cross-sectional view of the inside of a crankcase 20 as viewed from the right side.

FIG. 5 is a cross-sectional view of the inside of the crankcase 20 as viewed from the right side. This view depicts the locations of the crankshaft 30, transmission shaft 66 and output shaft 80 and the cross-section of the swash plate 67 of the hydraulic motor 58. An electric motor 74 drives the swash plate as is shown at an upper portion in FIG. 5. The electric motor 74 drives the swash plate 67 through a group of reduction gears (not shown). An oil pump assembly 90 is placed at the lower portion of the crankcase 20 and an oil strainer 91 connected to the oil pump assembly 90 is placed in an oil pan 92. An oil cooler 139 and a low pressure oil filter 140 are attached to a portion rearwardly of the left crankcase 20.

Figure 6A:
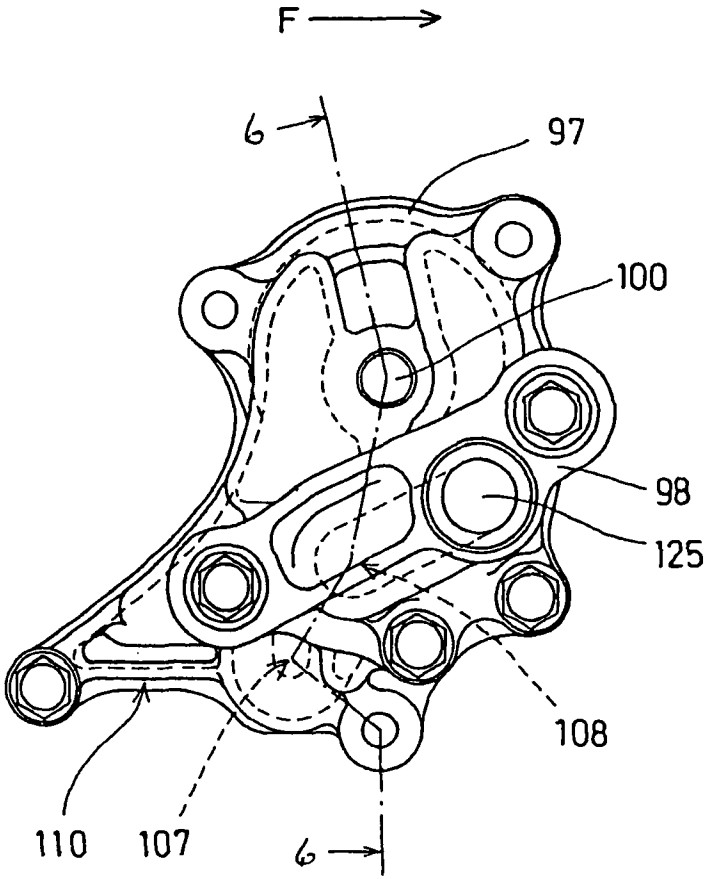
FIGS. 6(*a*) and 6(*b*) are assembly views of the oil pump assembly 90.
Figure 6B:
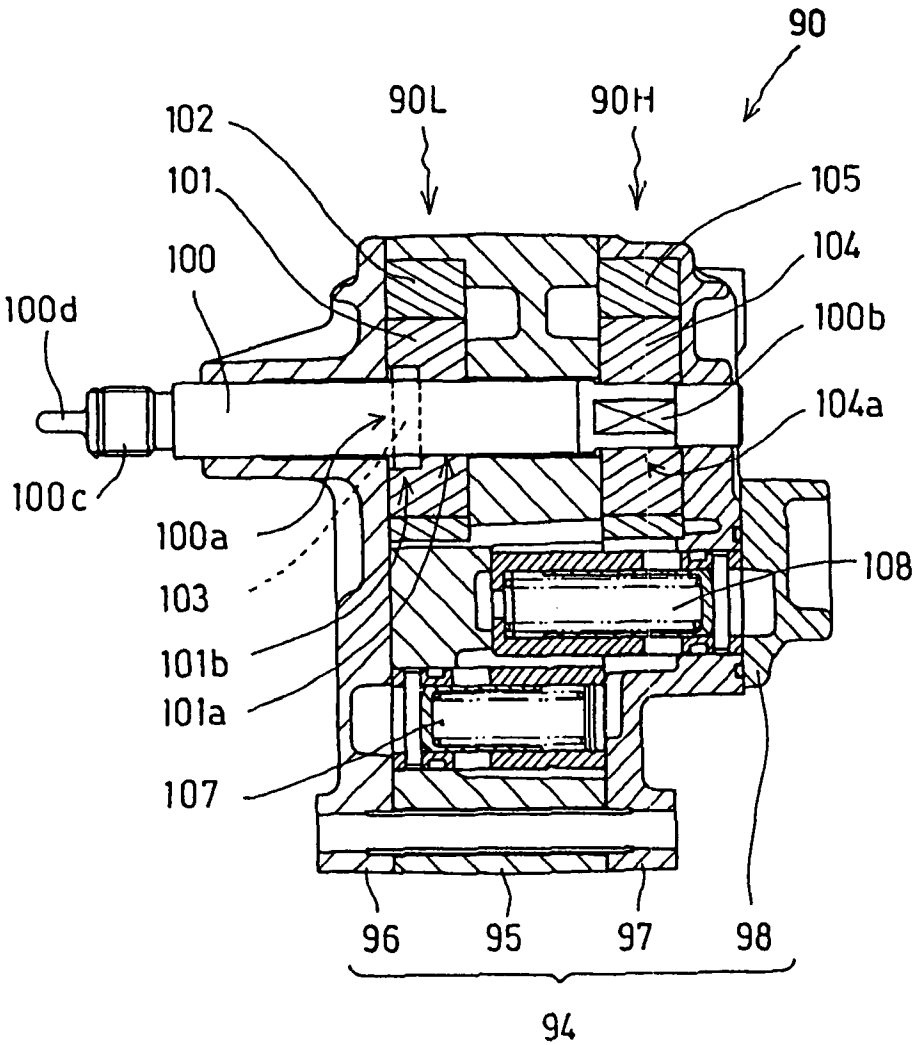

FIGS. 6(*a*) and 6(*b*) are an assembly view of the oil pump assembly 90. FIG. 6(*a*) is a right lateral view of the oil pump assembly 90 and FIG. 6(*b*) is a cross-sectional view taken along line 6-6 of FIG. 6(*a*). The oil pump assembly 90 is integrally composed of a left side low pressure oil pump 90L and a right side high pressure oil pump 90H. An oil pump outer shell 94 is composed of a center pump case body 95, a left cover 96, a right cover 97 and a right outer cover 98. An oil pump shaft 100 is attached for rotation to pass through the pump case body 95, left cover 96 and right cover 97. A low pressure oil pump inner rotor 101 is secured to the oil pump shaft 100 by means of a retaining pin 103 on the left side of the center of the oil pump. A low pressure oil pump outer rotor 102 is attached to the outer circumference of the inner rotor 101 in such a manner that the outer rotor 102 and the inner rotor 101 are engaged with each other. A retaining pin 103 is inserted into a retaining pin insertion hole 100*a* of the oil pump shaft 100. An oil pump shaft insertion hole 101*a* of a low pressure oil pump inner rotor 101 is formed with a retaining recessed portion 101 with which the retaining pin 103 is engaged.

A high pressure oil pump inner rotor 104 is fixedly fitted to the flat surface retaining portion 100*b* of the oil pump 100 on the right side of the center of the oil pump. A high pressure oil pump outer rotor 105 is attached to the outer circumference of the inner rotor 104 in such a manner that the outer rotor 105 and the inner rotor 104 are engaged with each other. The flat surface retaining portion 100*b* consists of four sub-portions formed by removing corresponding flat surfaces on the oil pump shaft 100. An oil pump shaft insertion hole 104*a* of the high pressure oil pump inner rotor 104 is a through hole having the same cross-section as that of a portion corresponding to the flat surface retaining portion 100*b* of the oil pump shaft 100, that is, being fitted to the flat surface retaining portion 100*b*.

A low pressure relief valve 107 and a high pressure relief valve 108 are attached to the lower portion of the oil pump assembly 90 with functions of maintaining the discharge pressures of the low pressure oil pump 90L and the high pressure oil pump 90H at predetermined pressures, respectively.

The oil pump shaft 100 is formed at its almost-left end with a spline 100*c* adapted to attach a pump driven sprocket described later thereto. In addition, the oil pump shaft is formed at its left end with a flat projection 100*d* adapted to connect with a water pump described later.

Figure 7A:
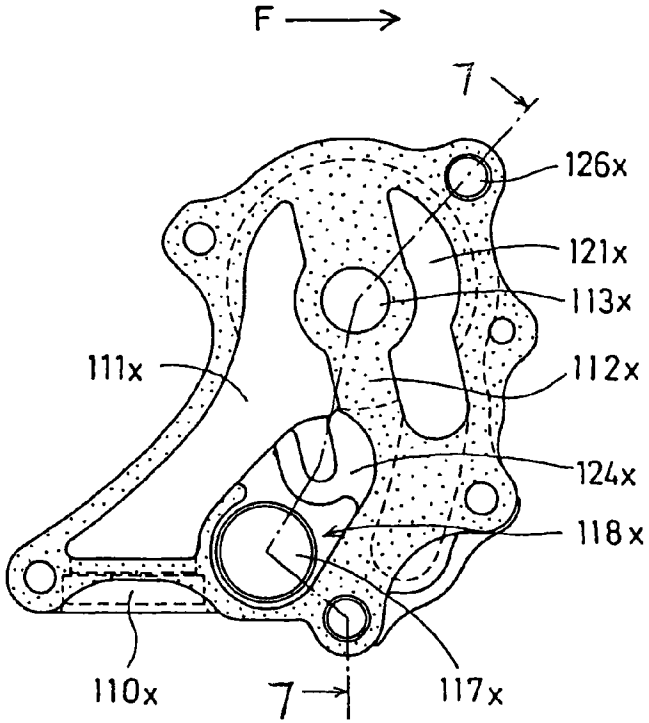
FIGS. 7(*a*), 7(*b*) and 7(*c*) are three-side view of a pump case body 95.
Figure 7B:
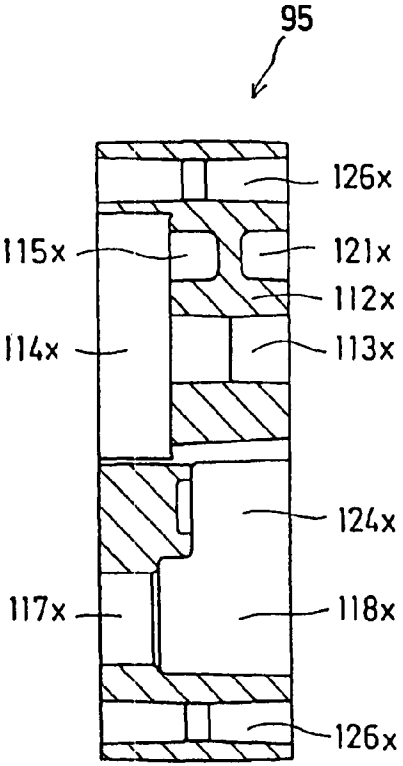
Figure 7C:
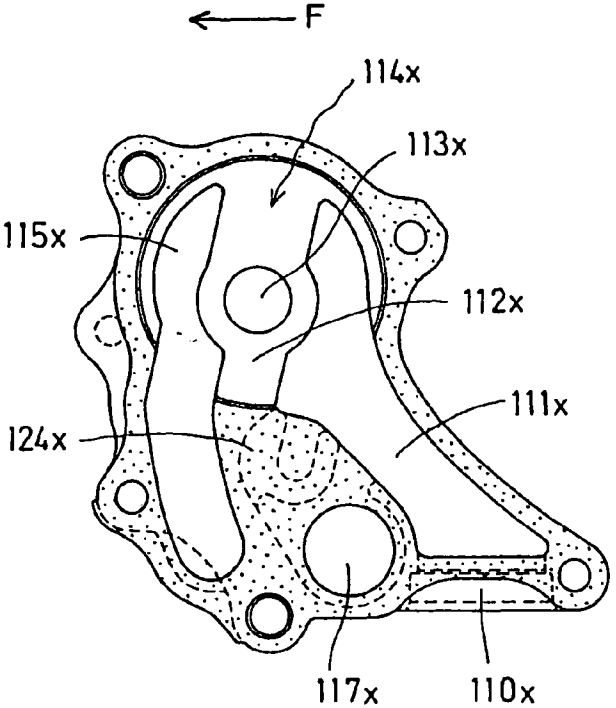

FIGS. 7(*a*) through 10(*d*) depict the pump case body 95, the left cover 96, the right cover 97 and the right outer cover 98 constituting the outer shell 94 of the oil pump assembly 90. A description will be hereinafter made of portions of each of the components mentioned above. In the description, symbols denoting the portions are lower-case alphabetical characters, which are suffixed to reference numerals denoting the components constituting the oil pump assembly, thus representing each of the portions belonging to corresponding one of the components with:

"x": a portion belonging to the pump case body 95

"y": a portion belonging to the left cover 96

"z": a portion belonging to the right cover 97

"w": a portion belonging to the right outer cover 98

Thus, the relationship between the whole and portions can be cleared. For example, the oil pump shaft insertion hole 113 represents the whole composed of a portion 113*x* belonging to the pump case body 95, a portion 113*y* belonging to the left cover 96, a portion 113*z* belonging to the right cover 97 and a portion 113*w* belonging to the right outside cover 98. Incidentally, FIGS. 6(*a*) and 6(*b*) do not describe reference numeral "113" denoting the entire oil pump shaft insertion hole for simplification of the drawing of the oil pump assembly. The same holds true for the other reference numerals.

FIGS. 7(*a*), 7(*b*) and 7(*c*) are three-side view of the pump case body 95. FIG. 7(*a*) is a right side view, FIG. 7(*b*) is a cross-sectional view taken along line 7-7 of FIG. 7(*a*) and FIG. 7(*c*) is a left side view. In FIGS. 7(*a*) and 7(*c*), an oil inflow hole 110*x* is bored in the lower portion of the pump case body 95 and an oil inflow passage 111*x* continuous with the oil inflow hole 10*x* extends upwardly. A partition wall 112*x* extending longitudinally is formed at the center portion of the pump case body 95. An oil pump shaft insertion hole 113*x* is bored in the partition wall 112*x* so as to pass therethrough. A low pressure pump chamber 114*x* is provided on the left side in FIG. 7(*b*). Referring to FIG. 7(*c*), a low pressure oil discharge passage 115*x* continuous with the low pressure pump chamber 114*x* is provided on a side opposite to the oil inflow passage 111*x* with respect to the partition wall 112*x* so as to extend downwardly. A low pressure relief valve attachment hole 117*x* is bored on the left side in FIG. 7(*b*) so as to communicate with a low pressure relief valve attachment space 118*x* placed on the right side in FIG. 7(*b*). Referring to FIG. 7(*a*), a high pressure oil discharge passage 121*x* is provided on a side opposite to the oil inflow passage 111*x* with respect to the partition wall 112*x*. A high pressure relief valve attachment space 124*x* is provided on a side opposite to the high pressure oil discharge passage 121*x* so as to be partitioned by the partition wall 112*x*. In addition, the high pressure relief valve attachment space 124*x* communicates with the low pressure relief valve attachment space 118*x* as shown in FIG. 7(*b*). The relief valve attachment spaces 118*x* and 124*x* each communicate with the oil inflow passage 111*x* as shown in FIG. 7(*a*). This is intended to return excessive oil discharged from the relief valve to the oil inflow passage 111*x*. Assembly screw insertion holes 126*x* are provided at a peripheral portion.

Figure 8A:
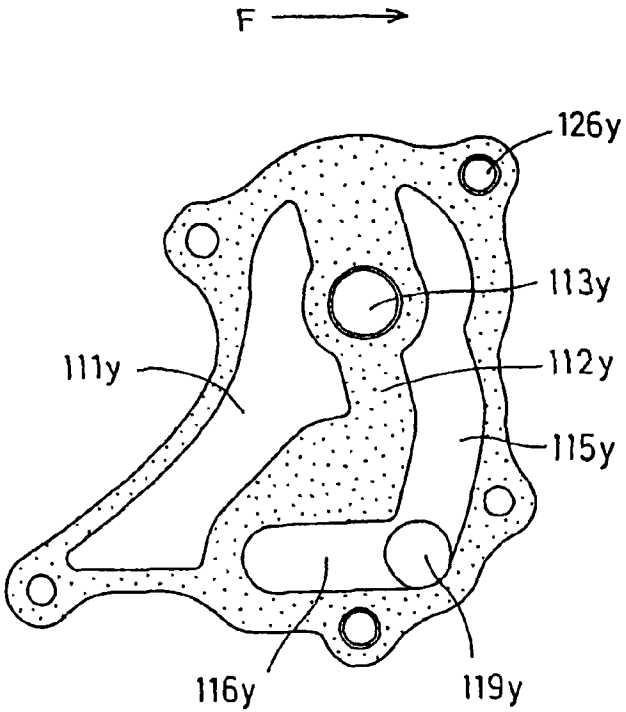
FIGS. 8(*a*), 8(*b*) and 8(*c*) are three-side view of a left cover 96.
Figure 8B:
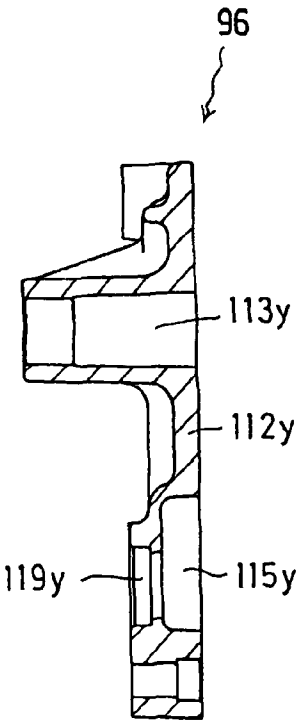
Figure 8C:
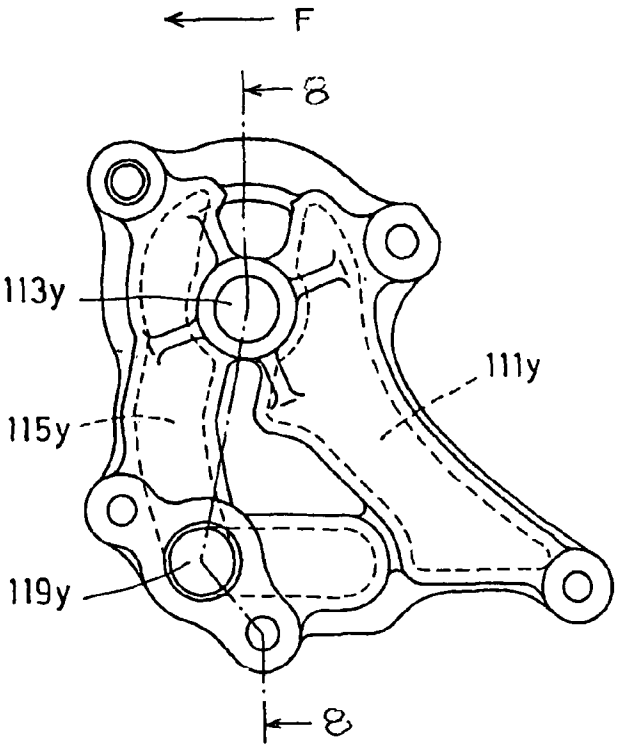

FIGS. 8(*a*), 8(*b*) and 8(*c*) are three-side view of the left cover 96. FIG. 8(*a*) is a right side view, FIG. 8(*b*) is a cross-sectional view taken along line 8-8 of FIG. 8(*c*) and FIG. 8(*c*) is a left side view. In FIG. 8(*a*), a partition wall 112*y* is provided in the center portion, an oil inflow passage 111*y* is provided on one side of the partition wall 112*y* and a low pressure discharge passage 115*y* is provided on the other side. These are adapted to cover the side faces of the partition wall 112*x*, oil inflow passage 111*x* and low pressure oil discharge passage 115*x* included in the pump case body 95. See, FIG. 7. An oil pump shaft insertion hole 113*y* is provided to pass through the partition wall 112*y*. A low pressure oil relief passage 116*y* that is continuous with the lower pressure oil discharge passage 115*y* is provided at the right lower portion, and communicates with the low pressure relief valve attachment hole 117*x* of the pump case body 95 shown in FIG. 7. A lower pressure discharge hole 119*y* is provided at the connection portion of the low pressure oil discharge passage 115*y* and the low pressure oil relief passage 116*y* so as to open on the left side of the oil pump assembly 90.

Figure 9A:
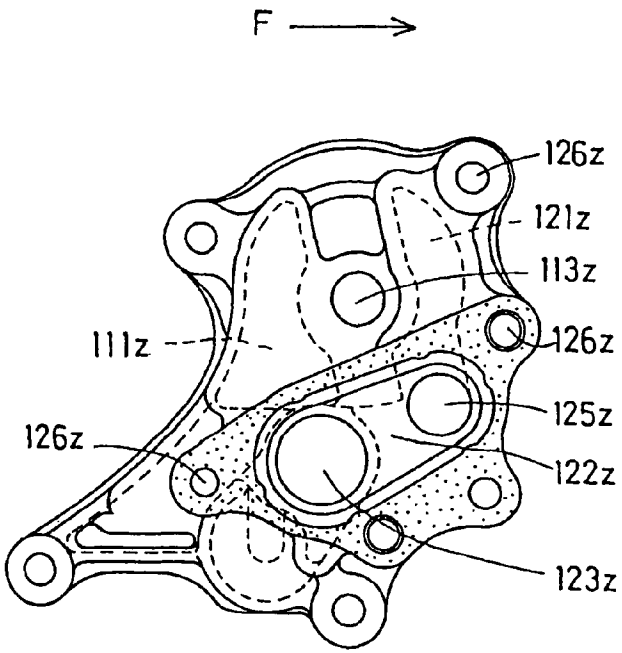
FIGS. 9(*a*), 9(*b*) and 9(*c*) are three-side view of a right cover 97.
Figure 9B:
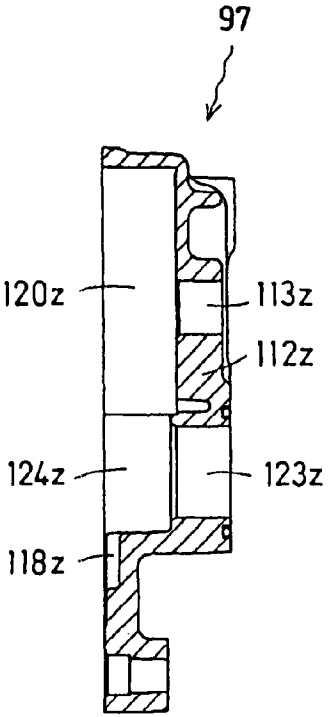
Figure 9C:
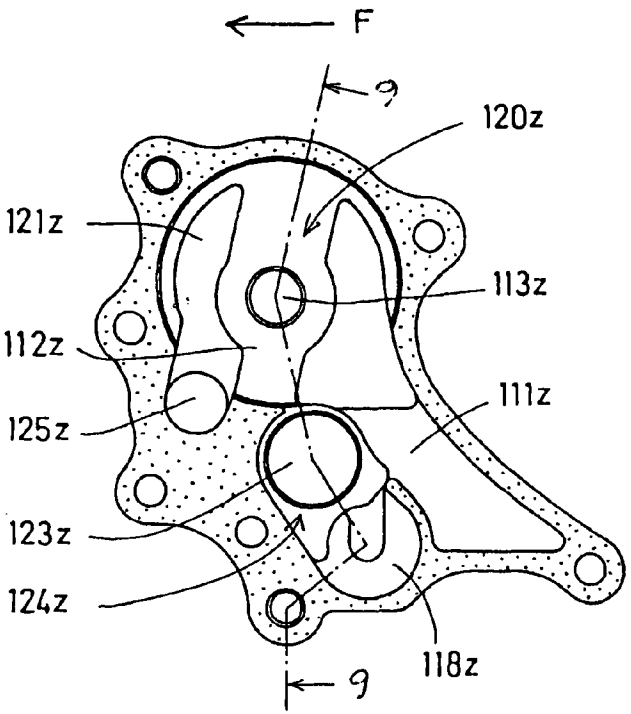

FIGS. 9(*a*), 9(*b*) and 9(*c*) are three-side view of the right cover 97. FIG. 9(*a*) is a right side view, FIG. 9(*b*) is a cross-sectional view taken along line 9-9 of FIG. 9(*c*) and FIG. 9(*c*) is a left side view. In FIG. 9(*b*), a high pressure pump chamber 120*z* is provided on the left side. In FIG. 9(*c*), a partition wall 112*z* is provided at the center portion on one side of which an oil inflow passage 111*z* is provided and on the other side of which a high pressure oil discharge passage 121*z* is provided. These are adapted to cover the side faces of the partition wall 112*x*, oil inflow passage 111*x*, and high pressure discharge passage 121*x* included in the pump case body 95. See, FIG. 7. An oil pump shaft insertion hole 113*z* is provided to pass through the partition wall 112*z*. A high pressure relief valve attachment hole 123*z* can be seen in FIGS. 9(*a*), 9(*b*) and 9(*c*). A high pressure relief valve attachment space 124*z* and an end of a low pressure relief valve attachment space 118*z* can be seen in FIGS. 9(*b*) and 9(*c*). A high pressure discharge hole 125*z* continuous with the high pressure discharge passage 121*z* can be seen in FIGS. 9(*a*) and 9(*c*). The high pressure discharge hole 125*z* communicates with a corresponding part of the right outer cover 98. A high pressure oil relief passage 122*z* is placed between the high pressure discharge hole 125*z* and the high pressure relief valve attachment hole 123*z*, and is shield with the right outer cover 98.

FIGS. 10(*a*), 10(*b*), 10(*c*) and 10(*d*) are four-side view of the right outer cover 98. FIG. 10(*a*) is a right side view, FIG. 10(*b*) is a cross-sectional view taken along line 10-10 of FIG. 10(*a*), FIG. 10(*c*) is a left side view and FIG. 10(*d*) is a cross-sectional view taken along line 11-11 of FIG. 10(*a*). A high-pressure oil relief passage 122*w* running on the left surface of the right outer cover 98 can be seen in FIGS. 10(*c*) and 10(*d*). This relief passage 122*w* is an oil passage adapted to connect the high pressure oil discharge hole 125*z* and the high pressure relief valve attachment hole 123*z* included in the right cover (FIG. 9). The high pressure discharge hole 125*w* of the right outer cover 98 communicates concentrically with the high pressure oil discharge hole 125*z* of the right cover 97 (FIG. 9). Assembly screw insertion holes 126*z* are provided at a peripheral portion.

Figure 11:
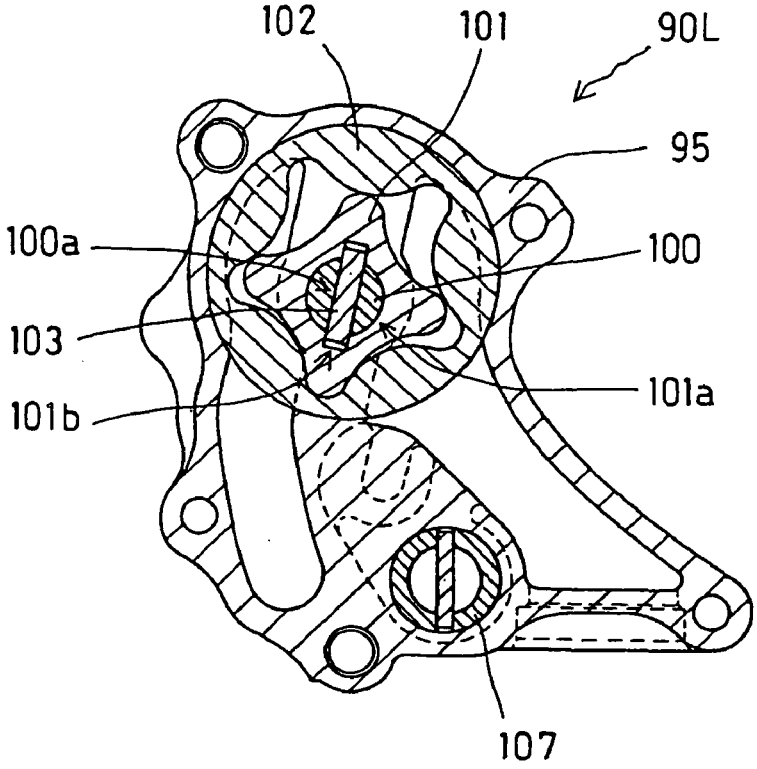
FIG. 11 is a cross-sectional view of a low pressure oil pump 90L.

FIG. 11 is a cross-sectional view of the low pressure oil pump 90L, also depicting a section of the low pressure relief valve 107. The inner rotor 101 and outer rotor 102 of the low pressure oil pump 90L are housed in the low pressure pump chamber 114*x*, see FIG. 7, formed in the pump case body 95. The inner rotor 101 of the low pressure oil pump 90L is retained by a retaining pin 103 fitted into the retaining pin insertion hole 100*a* of the oil pump shaft 100. The oil pump shaft insertion hole 101*a* of the inner rotor 101 is formed with a retaining recess 101*b* in which the retaining pin 103 is fitted. The cross-section of the low pressure relief valve 107 is taken along the position of a stopper pin (described later).

Figure 12:
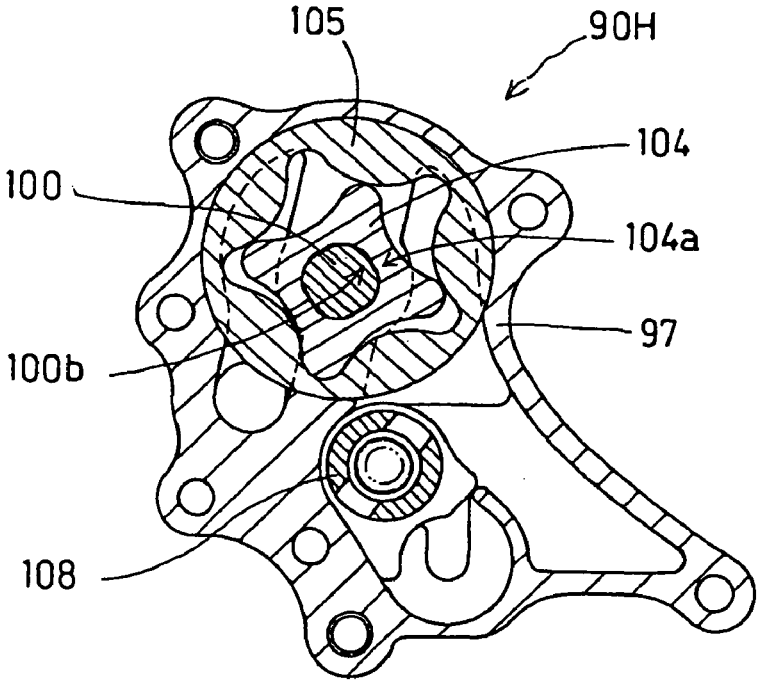
FIG. 12 is a cross-sectional view of a high-pressure oil pump 90H.

FIG. 12 is a cross-sectional view of the high pressure oil pump 90H, also depicting a section of the high pressure relief valve 108. The inner rotor 104 and outer rotor 105 of the high pressure oil pump 90H are housed in the high pressure pump chamber 120*z*, see FIG. 9, formed in the right cover 97. The inner rotor 104 of the high pressure oil pump 90H is retained in place by the flat surface retaining part 100*b* formed in the oil pump shaft 100 and the oil pump shaft insertion hole 104*a* having the same cross-section as that of the flat surface retaining part 100*b*. The cross-section of the high pressure relief valve 108 is taken along the position of the excessive oil discharge port.

Figure 13:
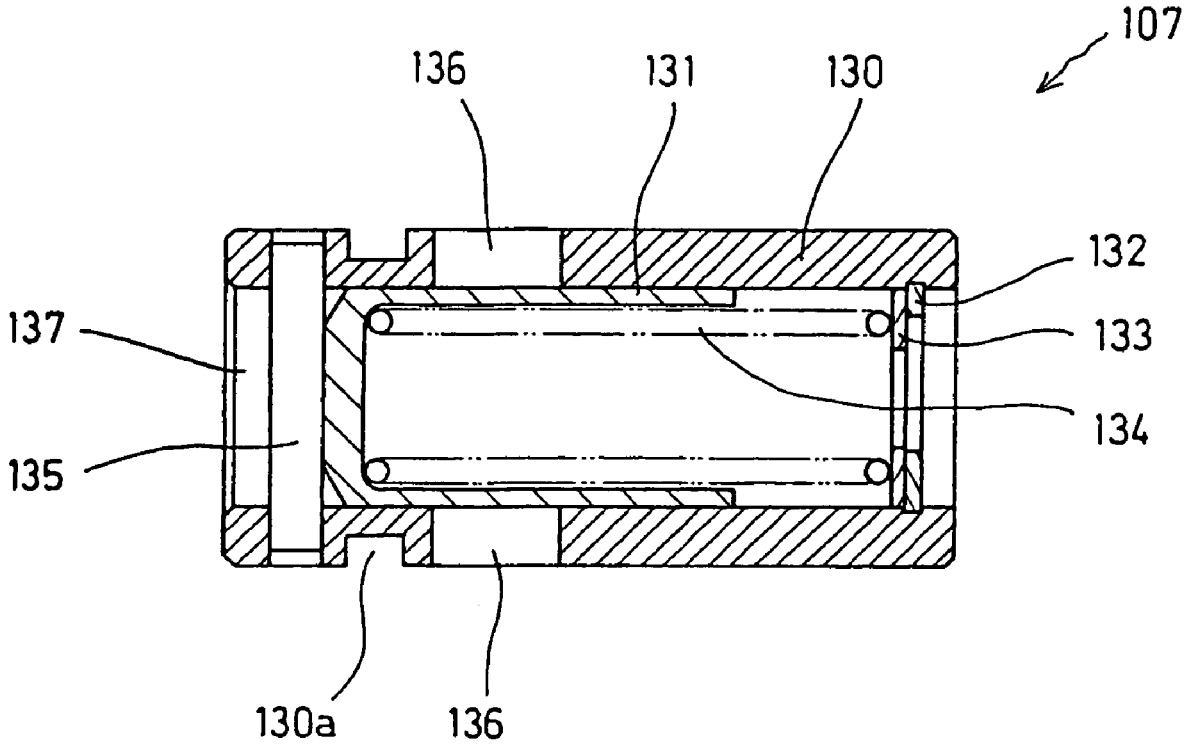
FIG. 13 is a cross-sectional view of a low pressure relief valve 107.

FIG. 13 is a cross-sectional view of the low pressure relief valve 107. The valve 107 includes a cylindrical case 130, an inner cylinder 131, a C-shaped clip 132, a washer 133, a coil spring 134, and a stopper pin 135. The cylindrical case 130 is provided with opposite opening ends. The inner cylinder 131 is slidably fitted in the cylindrical case 130, and has one end opened and the other end closed. The C-shaped clip 132 is fitted to the annular recess at the inside end of the cylindrical case. The washer 133 is in contact with the inside of the clip 132. The coil spring 134 is compressively placed between the washer 133 and the inside of the closed end of the inner cylinder 131. The stopper pin 135 is fitted into the through hole at the end of the cylinder case 130 in order to prevent the inner cylinder 131 from coming off. A pair of excessive oil discharge ports 136 is provided at the respective side surfaces of the cylindrical case. An O-ring attachment groove 130*a* is provided to surround a side surface of the cylindrical case 130 at a portion between the stopper pin 135 and the excessive oil discharge ports 136. An end located on a side of the stopper pin 135 of the low pressure relief valve 107 provides a pressurizing end space 137.

The low pressure relief valve 107 is inserted into the low pressure relief valve attachment hole 117*x* and is attached in the low pressure relief valve attachment space 118*x*. Pressure in the low pressure oil discharge passages 115*x*, 115*y* is applied to the pressurizing end 137 of the low pressure relief valve 107 through the oil relief passage 116*y*. As the pressure is increased, the inner cylinder 131 is moved against the urging force of the coil spring 134. When the pressure exceeds a predetermined value, the pressurizing end space 137 communicates with the excessive oil discharge port 136, so that excessive oil is discharged to the oil inflow passage 111*x*. Thus, the upper limit value of the pressure in the low pressure discharge passages 115*x*, 115*y* is maintained at a fixed value. The above description is made of the low pressure relief valve 107. Since the configuration and function of the high pressure relief valve 108 is almost the same as those of the low pressure relief valve 107 except that the high pressure relief valve 108 uses a stronger coil spring than the low pressure relief valve, the description is omitted for the high pressure relief valve 108.

Figure 14:
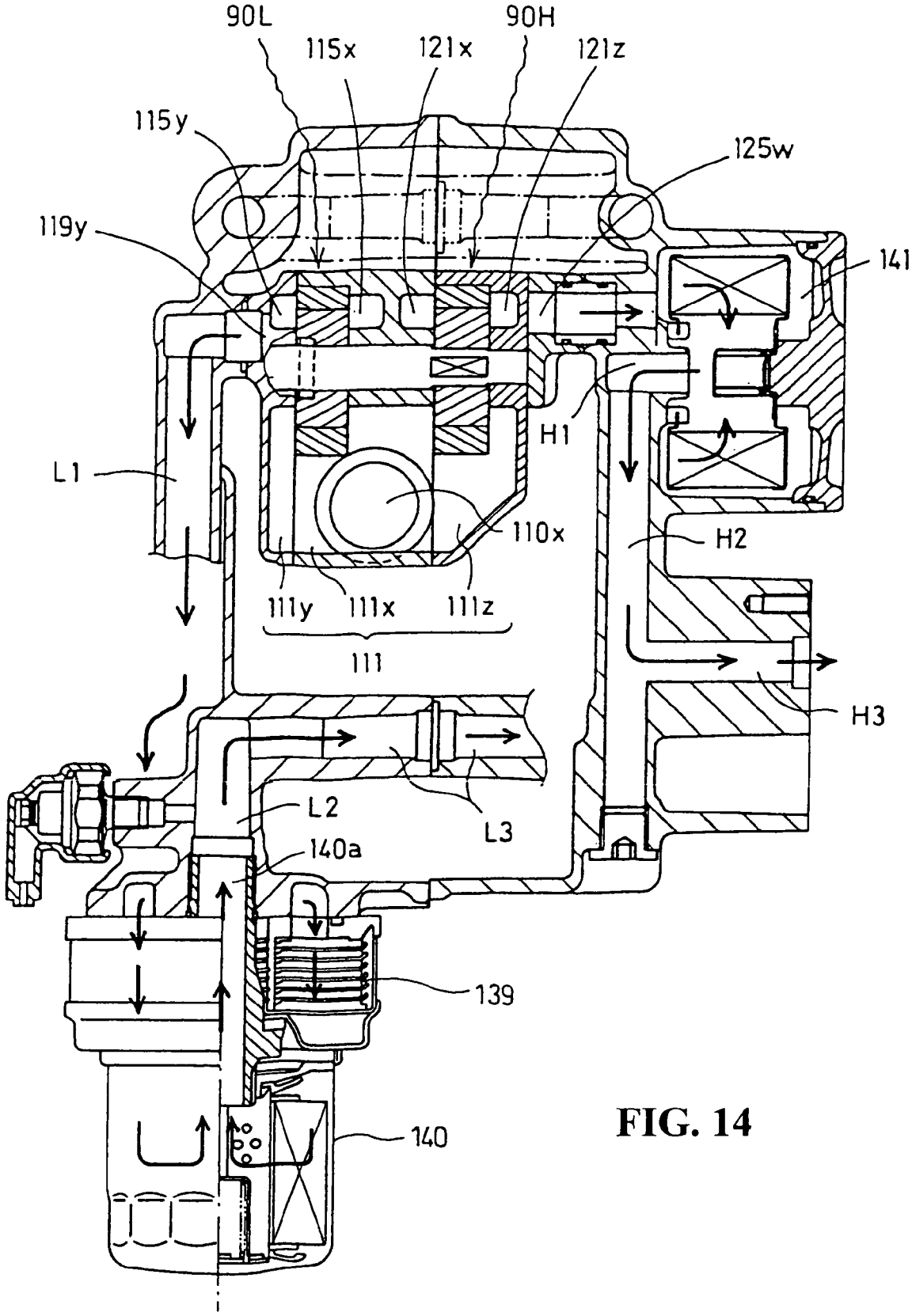
FIG. 14 depicts the horizontal cross-section of the oil pump assembly 90 and discharge passages as viewed from above.

FIG. 14 depicts the horizontal cross-section of the oil pump assembly 90 and the discharge passages as viewed from above. The oil inflow port 110*x* connected to the oil strainer 91 can be seen at the lower portion of the oil inflow passage 111. The oil in the low pressure oil discharge passages 115*x*, 115*y* of the low pressure oil pump 90L interflows and is discharged from the left side low pressure oil discharge hole 119*y*. Then, the oil flows through the oil passage L1 extending rearwardly, and moves toward the oil cooler 139 and the low pressure oil filter 140. The oil that has cooled by the oil cooler and is purified by the low pressure oil filter and passes through the outflow oil passage L2 communicating with an oil outflow pipe 140*a* placed at the center portion of the low pressure oil filter moves to the right in FIG. 14 via the oil passage L3.

The oil in the high pressure discharge passages 121*x*, 121*z* of the high pressure oil pump 90H interflows and is discharged from the right side high pressure oil discharge hole 125*w* to enter the high pressure oil filter 141 for purification. Then, the purified oil flows out from the outflow oil passage H1 communicating with the center portion of the high pressure oil filter and moves rearwardly through the oil passage H2. In addition, on the midway, the purified oil changes its direction to the right in FIG. 14 through the passage H3 and moves upwardly through a passage not shown and is used to lubricate the static hydraulic type continuously variable transmission 55.

Figure 15:
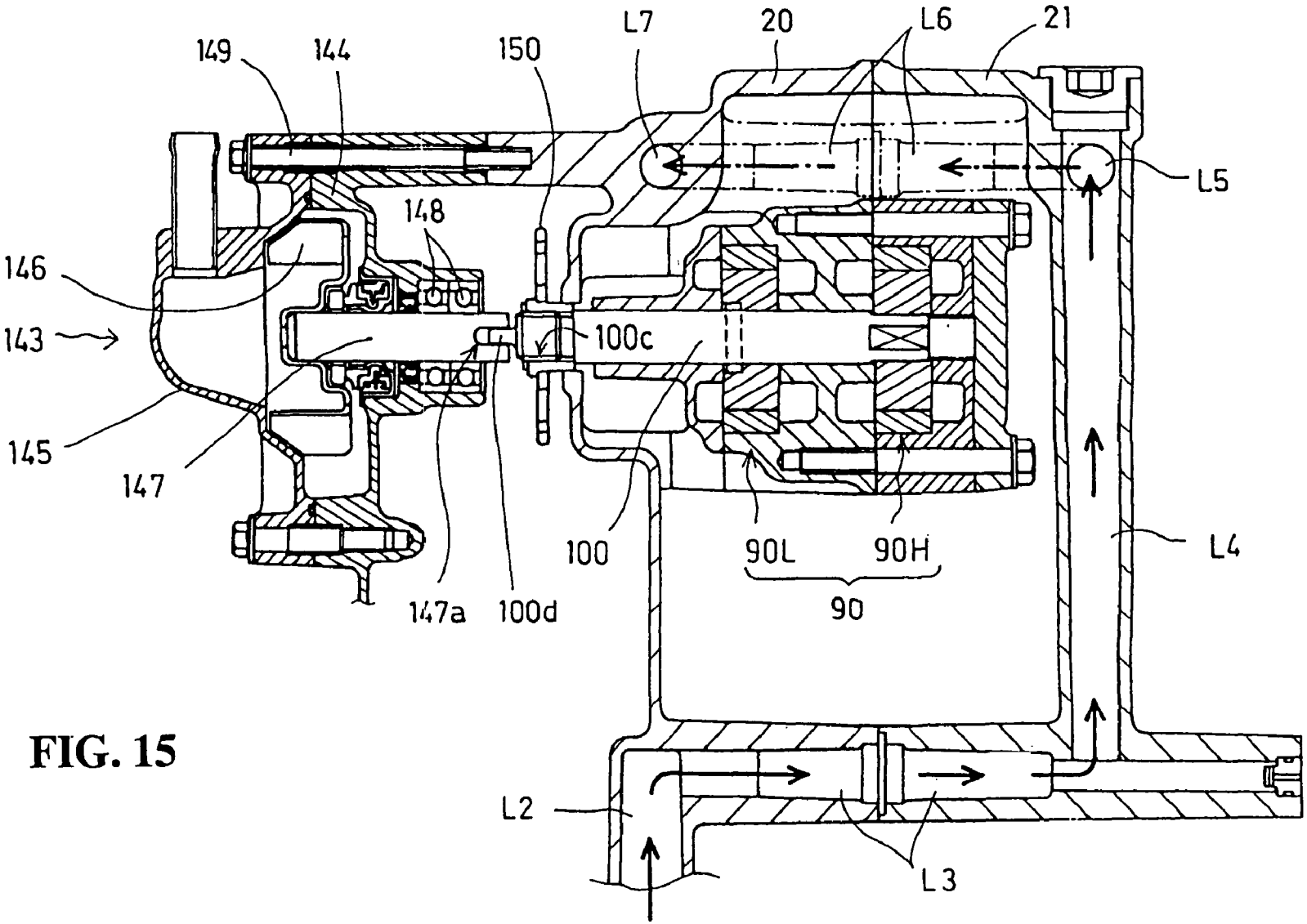
FIG. 15 depicts the horizontal cross-section of the oil pump assembly 90, the water pump 143 and an oil passage subsequent to the oil passage L3 of the low pressure oil pump, as viewed from above.

FIG. 15 depicts the horizontal cross-section of the oil pump assembly 90, the water pump 143 and an oil passage subsequent to the oil passage L3 of the low pressure oil pump, as viewed from above. The oil passage L3 of the low pressure oil pump shown in FIG. 14 further extends to the right, and connects with an oil passage L4 at the midway thereof and then the oil passage L4 extends forwardly. The oil passage L4 connects at its end with a right rising oil passage L5 so that oil moves upwardly to lubricate the right bearing 29 (FIG. 3) of the crankshaft. The right rising oil passage L5 connects at its midway with an oil gallery L6, which is connected to a left rising oil passage L7, so that oil moves upwardly to lubricate the left bearing 28. See, FIG. 3. FIG. 5 shows some of the oil passages described above.

The water pump 143 is mainly composed of a case 144, a cover 145, a vane wheel 146 and a water pump shaft 147. The vane wheel 146 is housed in the case 146 in such a manner so as to be secured to the end of the water pump shaft 147 therein. The water pump shaft 147 is journaled in the case 144 via ball bearings 148. The case 144 together with the cover 145 is attached to the left crankcase 20 with bolts 149. A flat slit-like recess 147*a* is formed at the end of the water pump shaft 147 outside the case so as to suitably receive the flat projection 100*d* formed at the end of the oil pump shaft 100. Thus, the water pump 143 operates simultaneously with the oil pump assembly 90.

The oil pump shaft 100 is formed at its end with the spline 100*c* to which the oil pump shaft driven sprocket 150 is fitted. The oil pump shaft driving sprocket 151, see FIG. 3, is carried on the crankshaft 30 at a position corresponding to the sprocket 150. The pump driving chain 152, see FIG. 2, is wound around both the sprockets. When the crankshaft 30 is rotated, the oil pump shaft 100 is rotated through the chain 152, and the water pump shaft 147 is rotated simultaneously therewith. Water discharged from the water pump 143 is used to cool the cylinder 25 and the cylinder head 26. The water that has passed the high temperature portions is cooled by the radiator 19, see FIG. 1, and then again returns to the water pump 143.

As descried above in detail, the oil pump assembly of the present invention has the following effects:

Since the respective axes of the plurality of relief valves are disposed parallel to the driving shaft, the drive shaft can be brought close to the relief valves, so that the relief valves can be arranged compactly.

(2) Since the discharge port of the relief valve is disposed in the width of the rotor as viewed from a direction perpendicular to the driving shaft, the relief valve can be brought close to the oil pump for a compact arrangement. In addition, the discharge oil passage is brought close to the pump suction port to shorten the relief oil passage, thereby simplifying the oil passage.

(3) Since the discharge ports of the relief valves are disposed in the width of the rotors and the relief valves are arranged to have most portions of the full lengths that overlap each other, the plurality of the relief valves can be further arranged compactly. Note that "to have most portions of the full lengths that overlap each other" means that "a plane perpendicular to the axes of the relief valves are shared by most parts of the full lengths of the relief valves."

(4) Since the oil pump assembly is composed of the pump case body and the pump covers shielding both the opposite sides of the pump case body and the plurality of the relief valves are disposed by inserting them into the corresponding cavities of the pump case body, the number of components can be reduced by eliminating members used to support the relief valves.

(5) Since the plurality of relief valves are disposed between the strainer and the oil pump as viewed from the lateral side of the power unit, an unused space between the strainer and the oil pumps is used to dispose the relief valves therein, thereby further reducing the size of the power unit.

(6) Since the plurality of relief valves are arranged along the oil stream line extending from the strainer to the oil pump, the plurality of relief valves can be further arranged compactly while ensuring sufficient oil passages.

(7) Since the power transmission portion between the crankshaft and the transmission uses the cam type torque damper and the backlash reduction gears, shocks can be reduced and the meshing engagement between the gears is quiet.

As descried above in detail, the oil pump structure of the present invention has the following effects:

Since the inner rotor of the high pressure oil pump is fitted and secured to a portion having a plurality of flat surfaces formed in the vicinity of an end of the driving shaft, it is unnecessary to provide a retaining recess which accommodates retaining pins. Further, the strength of connection between the inner rotor and the driving shaft can be increased and it is unnecessary to increase the diameter of the driving shaft, thereby reducing the size of the oil pump. In addition, in the case of the flat surface fitting compared to the retaining pins, not only the length of the flat surface can be set more freely but also the rotor having manufacturing or assembling errors can be attached to the driving shaft more freely in terms of the axial position thereof.

Since the oil that has passed the rotor is symmetrically discharged from the rotor to both sides of the rotor, the pressure of the oil discharged to both sides provides a rotor-centering effect, which reduces the contact between the rotor and the pump chamber, thereby suppressing frictional resistance therebetween. Accordingly, load acting on the driving shaft is reduced, so that the diameter of the driving shaft can be reduced.

The power transmission means is provided at the end of the driving shaft on the side of the low pressure oil pump, the end of the driving shaft of the water pump is disposed coaxially with the end, and both ends are fitted and coupled to each other. Therefore, a distance between the power transmission means and the projecting-recessed connection portion located at the end of the driving shaft is small, so that torsion acting on the driving shaft is reduced. Accordingly, it is unnecessary to reinforce the projecting-recessed connection portion and reduce the diameter of the driving shaft.

In the present embodiment, the inner rotors are connected to the oil pump shaft in such a manner that the retaining pin is used to connect the inner rotor of the low pressure oil pump to the oil pump shaft and the flat retaining portion is used to fit and connect the inner rotor of the high pressure oil pump to the oil pump shaft. Therefore, after the inner rotors of the high and low pressure oil pumps are built in the outer shell of the oil pumps, the oil pump shaft is inserted into the rotor center hole from the side of the low pressure oil pump, thereby connecting the oil pump shaft to each rotor. Thus, the assembling work can be facilitated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An oil pump assembly comprising:

a plurality of pump chambers constituting a plurality of oil pumps, respectively;

a plurality of rotors fitted into the pump chambers, respectively;

a single driving shaft operatively connected to the plurality of rotors to form a single body;

wherein oil pumped up from an oil pan is supplied under pressure from the plurality of oil pumps to different associated destinations in a power unit, the plurality of oil pumps including a high-pressure pump and a low-pressure pump; and wherein the oil pumps are provided with respective relief valves adapted to pass oil discharged from the corresponding pump chambers therethrough;

wherein each of the relief valves is a cylinder-shaped relief valve with a longitudinal axis along a centerline thereof, the longitudinal axis of each of the cylinder-shaped relief valves and a longitudinal axis of said driving shaft being parallel to each other and displaced apart from each other, wherein each of the cylinder-shaped relief valves has a pair of discharge ports formed as a pair of windows which have closed perimeters and which open through a circumferential wall of the relief valve in a direction perpendicular to the longitudinal axis of the relief valve, and wherein the relief valves are off-set from each other in an axial direction with only a portion of lengths of the relief valve overlapping each other, and with the pair of windows in one of the relief valves not overlapping the pair of windows in the other of the relief valves in the axial direction.

2. The oil pump assembly according to claim 1, wherein the windows are located away from each end of the cylinder-shaped relief valves, and the closed perimeter of each of the discharge ports is four-sided.

3. The oil pump assembly according to claim 1, wherein an outer shell of the oil pump assembly is composed of a pump case body and pump covers shielding lateral sides of the pump body, the pump chambers are defined between the pump case body and the pump covers to house the rotors in the corresponding pump chambers, and the plurality of relief valves are arranged to be inserted in cavities of the pump case body.

4. The oil pump assembly according to claim 2, wherein an outer shell of the oil pump assembly is composed of a pump case body and pump covers shielding lateral sides of the pump body, the pump chambers are defined between the pump case body and the pump covers to house the rotors in the corresponding pump chambers, and the plurality of relief valves are arranged to be inserted in cavities of the pump case body.

5. The oil pump assembly according to claim 1, wherein the plurality of relief valves are disposed between a strainer and the oil pumps as viewed from the lateral side of the power unit.

6. The oil pump assembly according to claim 4, wherein the plurality of relief valves are disposed between a strainer and the oil pumps as viewed from the lateral side of the power unit.

7. The oil pump assembly according to claim 2, wherein the plurality of relief valves are disposed between a strainer and the oil pumps as viewed from the lateral side of the power unit.

8. The oil pump assembly according to claim 3, wherein the plurality of relief valves are disposed between a strainer and the oil pumps as viewed from the lateral side of the power unit.

9. The oil pump assembly according to claim 5, wherein the plurality of relief valves are arranged parallel to each other along an oil stream line of an oil inflow passage extending from the strainer to the oil pumps.

10. The oil pump assembly structure according to claim 1, wherein the relief valve for the high-pressure pump is larger than the relief valve for the low-pressure pump.

11. The oil pump assembly according to claim 5, wherein an outer shell of the oil pump assembly is composed of a pump case body and pump covers shielding lateral sides of the pump body, the pump chambers are defined between the pump case body and the pump covers to house the rotors in the corresponding pump chambers, and the plurality of relief valves are arranged to be inserted in cavities of the pump case body.

* * * * *